US009212573B2

(12) United States Patent
Von Schimonsky et al.

(10) Patent No.: US 9,212,573 B2
(45) Date of Patent: Dec. 15, 2015

(54) INTERNAL COMBUSTION ENGINE HAVING ELECTROHYDRAULIC VALVE CONTROL AND METHOD FOR OPERATING SAID INTERNAL COMBUSTION ENGINE

(75) Inventors: Lothar Von Schimonsky, Gerhardshofen (DE); Camilo Costa, Herzogenaurach (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 792 days.

(21) Appl. No.: 13/513,947

(22) PCT Filed: Nov. 25, 2010

(86) PCT No.: PCT/EP2010/068223
§ 371 (c)(1),
(2), (4) Date: Jun. 5, 2012

(87) PCT Pub. No.: WO2011/069836
PCT Pub. Date: Jun. 16, 2011

(65) Prior Publication Data

US 2012/0240886 A1 Sep. 27, 2012

Related U.S. Application Data

(60) Provisional application No. 61/267,553, filed on Dec. 8, 2009.

(51) Int. Cl.
*F01L 9/02* (2006.01)
*F01L 1/344* (2006.01)

(52) U.S. Cl.
CPC ..... *F01L 9/025* (2013.01); *F01L 2001/34446* (2013.01)

(58) Field of Classification Search
CPC .. F01L 9/023; F01L 9/025; F01L 2001/34446
USPC ..... 123/90.12
See application file for complete search history.

(56) References Cited

U.S. PATENT DOCUMENTS

2004/0000276 A1* 1/2004 Borean et al. ..... 123/90.12
2010/0168987 A1* 7/2010 De Cristoforo et al. ..... 701/105

FOREIGN PATENT DOCUMENTS

| | | |
|---|---|---|
| EP | 1031706 | 8/2000 |
| EP | 1344900 | 9/2003 |
| EP | 2060754 | 5/2009 |
| JP | 61164009 | 7/1986 |
| WO | 9807965 | 2/1998 |

OTHER PUBLICATIONS

Hugues, Wanlin, "Hydraulic Valve Lift Mechanism for an Engine", Research Disclousre, Mason Publication, Hampshire, GB, vol. 441, no. 101, Jan. 1, 2001.

* cited by examiner

*Primary Examiner* — Hieu T Vo
*Assistant Examiner* — Arnold Castro
(74) *Attorney, Agent, or Firm* — Volpe and Koenig, P.C.

(57) ABSTRACT

An internal combustion engine (4) having an electrohydraulic valve control (1) for the variable lift drive of a gas exchange valve (3) is provided. The hydraulic valve (15) is actuated by an electronic control module (16) such that a gas exchange valve stroke (19) required for a charge change is adjusted during the cold start phase of the internal combustion engine (4) within a minimum stroke height (h-min) and a maximum closing time (α-max). A method for operating the internal combustion engine (4) is also provided.

5 Claims, 2 Drawing Sheets

INTERNAL COMBUSTION ENGINE HAVING ELECTROHYDRAULIC VALVE CONTROL AND METHOD FOR OPERATING SAID INTERNAL COMBUSTION ENGINE

BACKGROUND

The present invention relates to an internal combustion engine having electrohydraulic valve control for the variable-stroke driving of a gas exchange valve to which a spring force is applied in the closing direction, and a method for operating said internal combustion engine. This engine comprises a camshaft and a hydraulic system arranged to act as a drive between the camshaft and the gas exchange valve, said system being connected to a hydraulic fluid supply of the internal combustion engine and including the following:

a first hydraulic piston driven by a cam of the camshaft, and a second hydraulic piston that drives the gas exchange valve in the opening direction, a pressure chamber delimited by the first hydraulic piston and by the second hydraulic piston, having a modifiable volume and a control channel that connects the pressure chamber to a pressure relief chamber, an electrically controlled hydraulic valve, situated in the control channel, that permits a flow of hydraulic medium through the control channel in the open position of the hydraulic valve, and that blocks said flow in the closed position of the hydraulic valve.

The internal combustion engine further includes an electronic control module for controlling the hydraulic valve as a function of operating parameters of the internal combustion engine.

Internal combustion engines having electrohydraulic valve drives in which a partial volume of the pressure chamber, acting as a so-called hydraulic rod, can be continuously guided off into the pressure relief chamber when the hydraulic valve is open, so that the lift determined by the cam is correspondingly transmitted completely, partially, or not at all to the gas exchange valve, are known from many references in the patent literature. The design of the valve controlling of an internal combustion engine of this type is described in the article "Elektrohydraulische Ventilsteuerung mit dem 'MultiAir'-Method [Electrohydraulic Valve Controlling with the 'MultiAir' Method]," published recently in the Motortechnische Zeitschrift (MTZ), December 2009. This article also indicates an engine characteristic map having different stroke curves that—based on the cam lift—are transmitted to the gas exchange valve in modified form as a function of the operating point by the subsequently connected hydraulic system. Also presented is the electronic control module for controlling the hydraulic valve, there in the form of an integrated engine control device.

Of course, the operating characteristic of electrohydraulic valve drives is significantly dependent on the properties of the hydraulic medium, and in particular its momentary state of viscosity, mainly influenced by temperature. An essential cause of this dependence is to be found in the so-called hydraulic valve brake, which is part of the hydraulic system and which replaces the valve closing ramp provided in conventional mechanical valve drives. As is known, the hydraulic valve brake has the task of forming a stroke of the gas exchange valve, decoupled from the cam lift, in such a way that the closing gas exchange valve always reaches the valve seat with a seating speed that is mechanically and acoustically acceptable. At the same time, the hydraulic valve brake is to be made such that the target/actual deviations of the gas exchange valve closing time point, which impair the charge changing of the internal combustion engine, are minimal.

Hydraulic valve brakes are customarily constructed such that shortly before the closing of the gas exchange valve the hydraulic medium displaced by the second hydraulic piston at the gas exchange valve side has to pass a throttle point whose hydraulic resistance produces a braking of the gas exchange valve stroke to the specified seating speed. However, the viscosity-temperature curve of the hydraulic medium, whose viscosity increases greatly as the temperature decreases, limits the functionality of the hydraulic valve brake to a temperature window in such a way that below a boundary temperature, the closing time point of the gas exchange valve fluctuates and/or is delayed in an impermissibly strong manner. In the extreme case, the gas exchange valve does not reach the valve seat at all, and, with regard to the charge changing and combustion processes of the internal combustion engine, remains open in an impermissible manner between two rotations of the camshaft.

SUMMARY

The present invention is therefore based on the object of developing an internal combustion engine having electrohydraulic valve controlling of the type noted above, and of providing a method for operating said internal combustion engine, in such a way that the functionality of the electrohydraulic valve controlling is present even given very high viscosity of the hydraulic medium, i.e. in a temperature window that is expanded to include lower temperatures.

This object is achieved with regard to the device in that the electronic control device is configured so as to control the hydraulic valve as a function of the operating hydraulic medium temperature or viscosity and/or of the operating pressure in the hydraulic medium supply, in such a way that during an engine operating phase that includes one or immediately successive rotations of the camshaft, only a predetermined partial volume of the pressure chamber is filled with hydraulic medium, and the hydraulic valve is in the closed position at least during each overall lift phase of the cam.

In other words, according to the present invention it is provided that for a specified number of working cycles of the internal combustion engine, only a partial volume of the pressure chamber is filled with hydraulic medium, and this partial volume remains unmodified at least during the cam lift phase (apart from unavoidable leakages). A gradual shut off of hydraulic medium from the pressure chamber, controlled through targeted controlling of the hydraulic valve, thus does not take place in any phase of the cam lift.

The defined presetting of the partial volume of hydraulic medium situated in the pressure chamber takes place through a deliberate stroke loss of the hydraulic rod during one or more rotations of the camshaft before the engine operating phase, and during the engine operating phase causes the gas exchange valve to open later relative to the cam lift and to close earlier, with correspondingly reduced stroke height. In the case of highly viscous hydraulic medium, the hydraulic valve brake remains for a longer time interval between two camshaft rotations, during which interval the gas exchange valve can securely reach the valve seat. With regard to a successful charge changing process, the quantity of the partial volume is to be set in such a way that the gas exchange valve does not fall below a minimum stroke height, and does not go beyond a maximum closing time point. This holds also for the case in which the hydraulic valve is opened in the phases between the cam lifts, and thus enables a refilling of the pressure chamber with hydraulic medium from the pressure relief chamber.

Preliminary trials on the part of applicant relating to the present invention have, in contrast, shown the following: a gradual shut off and refilling of the pressure chamber that is true to the cycle, i.e. takes place upon each camshaft rotation, with the goal of significantly reducing the stroke and thus the opening duration of the gas exchange valve can on the one hand fail if the high viscosity of the hydraulic medium prevents a sufficiently fast and complete refilling of the pressure chamber with hydraulic medium from the pressure relief chamber. This holds in particular when the pressure in the hydraulic medium supply of the internal combustion engine is (still) insufficient. On the other hand, the hydraulic valve has the property that at low temperatures it can no longer close against the then highly viscous stream of hydraulic medium through the control channel. The latter condition thus prevents the hydraulic valve from first closing during the cam lift in engagement, in order to produce an opening that is later relative to the cam lift, and a correspondingly earlier closing of the gas exchange valve.

From the preceding considerations, it is clear that the present invention in particular promotes a successful starting and initial warm-up phase of the cold internal combustion engine in very low ambient temperatures (typically, a successful starting is ensured even at an ambient, and engine, temperature of −30° C.), especially since under such conditions the buildup of pressure in the hydraulic medium supply of the internal combustion engine is initiated with a particularly strong delay. As mentioned above, an insufficient pressure in the hydraulic medium supply of the internal combustion engine can prevent a complete refilling of the pressure chamber to such an extent that during the cam lift phase a controlled modification or reduction of the gas exchange valve stroke through cycle-true gradual shut off of hydraulic medium from the pressure chamber is not possible. In particular, the present invention enables an inlet opening that is later relative to the cam lift even given cold, i.e. highly viscous, hydraulic medium. As explained above, this is not possible with a conventional controlling of the hydraulic valve, because the hydraulic valve does not close, or does not close quickly enough, against highly viscous hydraulic medium in the control channel.

However, the present invention is not limited to its application with cold hydraulic medium, but rather can also be used at other operating temperatures of the internal combustion engine.

In the sense of the present invention, a cycle-true refilling of the pressure chamber between the cam lift phases can be omitted if the refilling is used only to compensate unavoidable gap leakages from the pressure chamber and the leakages are negligibly small in the case of very high hydraulic medium viscosity. To this extent, during the above-mentioned engine operating phase a controlling of the hydraulic valve can also be provided such that the hydraulic valve remains closed not only during the cam lift phase in engagement, but also during the entire engine operating phase.

Moreover, it can be provided that the number of rotations of the camshaft during the engine operating phase is predetermined by the electronic control means as a function of the hydraulic medium temperature, determined at the time of the starting process of the internal combustion engine. The essential parameter for this predetermined number of rotations is the temperature of the hydraulic medium during the starting process; here the parameter-dependent number of rotations can be determined by test bench trials and stored in a characteristic map of the electronic control module as a control quantity. Alternatively to the predetermined duration of the engine operating phase, it can also be provided to set this duration as a function of current operating parameters, in particular the hydraulic medium temperature.

In addition, the noted engine operating phase can be carried out once or, if necessary, multiple times in succession. For the subsequent "normal operation" of the electrohydraulic valve controlling with cycle-true gradual shut off and refilling of the pressure chamber, the electronic control module should be configured so as to control the hydraulic valve in such a way that during a further engine operating phase following the engine operating phase, said further phase including immediately successive rotations of the camshaft, the pressure chamber is refilled at least almost completely with hydraulic medium before each lift phase of the cam.

The underlying object of the present invention is achieved with regard to the method in that the electronic control module is configured to control the hydraulic valve as a function of the operating hydraulic medium temperature or viscosity and/or the operating pressure in the hydraulic medium supply, the following method steps being provided, which follow one another in time:

opening of the hydraulic valve at a time within the lift phase of the cam and closing of the hydraulic valve at a time such that only a predetermined partial volume of the pressure chamber is filled with hydraulic medium, and holding the hydraulic valve in the closed position during an engine operating phase that includes one, or immediately successive, rotations of the camshaft, the hydraulic valve being in the closed position at least during each overall lift phase of the cam.

BRIEF DESCRIPTION OF THE DRAWINGS

Additional features of the present invention result from the following description and from the drawings.

DETAILED DESCRIPTION OF THE PREFERRED EMBODIMENTS

Figure 4:
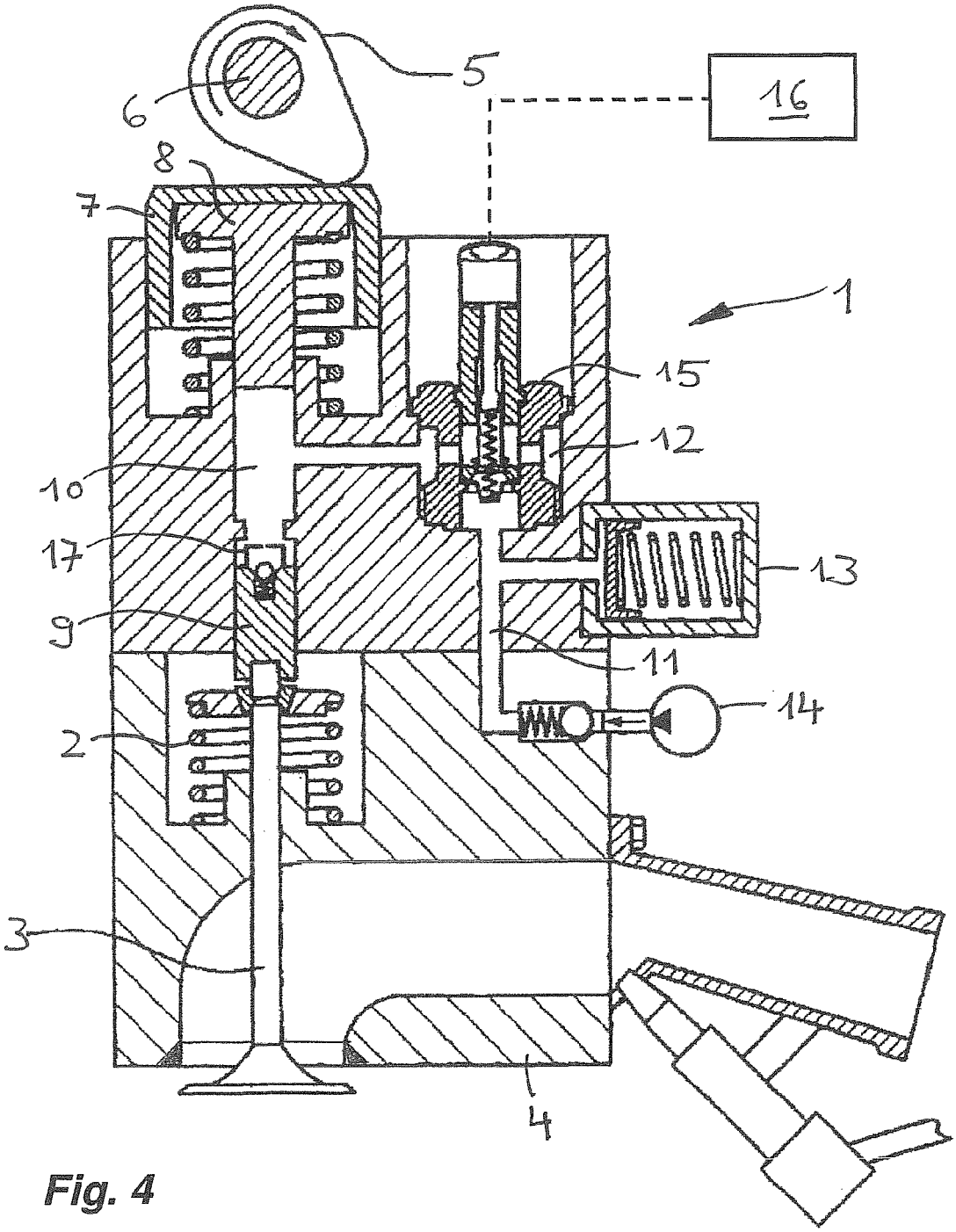
FIG. 4 shows a schematic diagram of the electrohydraulic valve controlling.

The starting point of the description is the schematic representation shown in FIG. 4 of a known electrohydraulic valve control 1. The valve control 1 is used for the variable-stroke drive of a gas exchange valve 3, to which force is applied in the closing direction by a valve spring 2, of an internal combustion engine 4, and comprises as essential components a cam 5 of a camshaft 6, a first hydraulic piston 8 driven by cam 5, here via a tappet 7, a second hydraulic piston 9 that drives the gas exchange valve 3 in its opening direction, a pressure chamber 10, running between the first hydraulic piston 8 and the second hydraulic piston 9, having a modifiable volume and a pressure relief chamber 11 that is connected to the pressure chamber 10 via a control channel 12, and a spring-loaded pressure storage device 13. The hydraulic system situated with regard to driving between the camshaft 6 and the gas exchange valve 3 is connected to a hydraulic medium supply 14 of the internal combustion engine, here its lubricant circuit.

In the control channel 12 there is situated an electrically controlled hydraulic valve 15, designed as a 2/2-way switching valve, which in its currentless, open position permits a flow of hydraulic medium through the control channel 12, and in its closed position, supplied with current, blocks said flow. The electric controlling of the hydraulic valve 15 as a function of operating parameters of the internal combustion engine 4 takes place via an electronic control module 16, as an integrated component of the engine control device.

The known functioning of the valve control device 1 can be summarized as follows: the hydraulic medium situated in the pressure chamber 10 acts as a hydraulic rod, the lift determined by the cam 5 being transmitted to the gas exchange valve 3 when the hydraulic valve 15 is closed, and being partly or completely guided off into the pressure relief chamber 11 when the hydraulic valve 15 is open. The hydraulic decoupling of the cam lift and of the gas exchange valve stroke requires a hydraulic valve brake 17 that throttles the hydraulic medium pressed back by the second hydraulic piston 9, and thus brakes the closing gas exchange valve 3 to a mechanically and acoustically acceptable seating speed on the valve seat 18.

Figure 1:
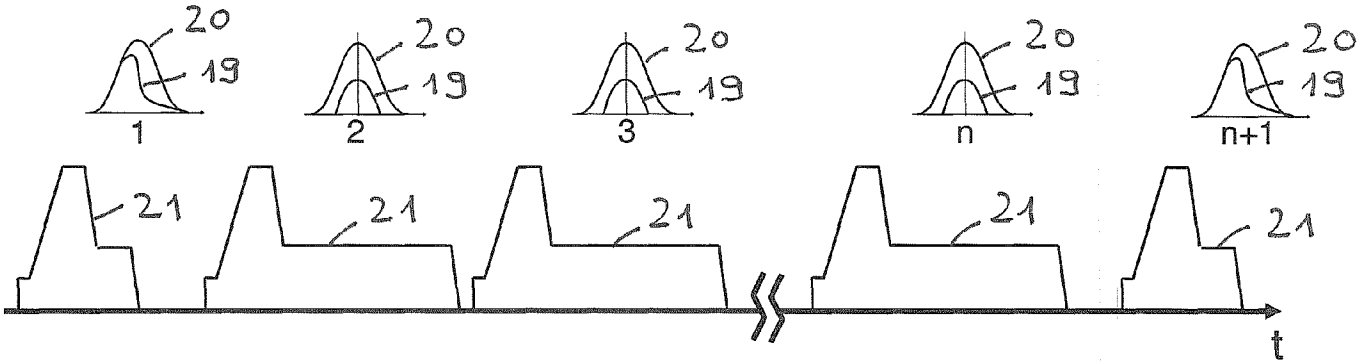
FIG. 1 shows a temporal sequence of lifts of the cam and of the gas exchange valve with associated current characteristics at the hydraulic valve.
Figure 2:
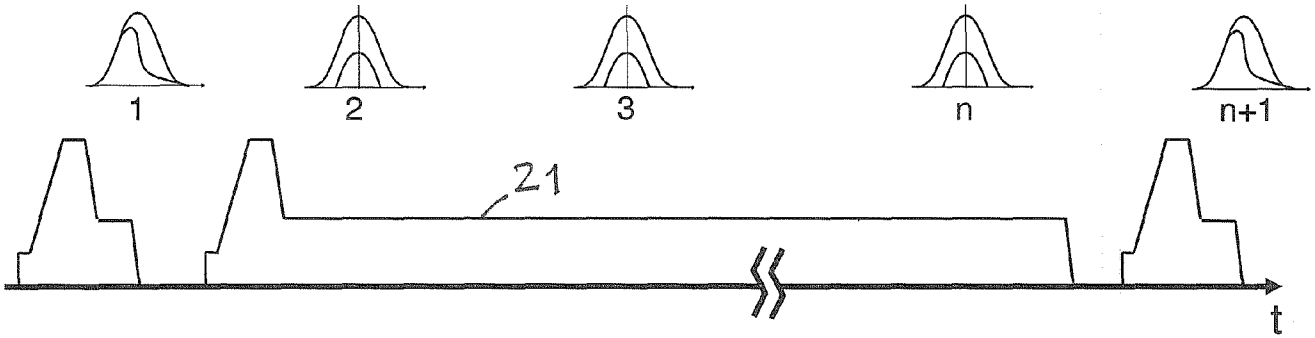
FIG. 2 shows a temporal sequence corresponding to FIG. 1, the hydraulic valve being in the closed position during the overall engine operating phase.

FIGS. 1 and 2 each show, in a temporal sequence, how the currentless open hydraulic valve 15 is controlled during the starting process of the internal combustion engine 4, with an ambient and engine temperature significantly below 0° C. and with correspondingly highly viscous hydraulic medium, and the strokes 19 that thereby result at the gas exchange valve 3 relative to the cam lift 20. In the diagrams, the current characteristic 21 at the hydraulic valve 15 is shown at the bottom, and the stroke 19 of the gas exchange valve 3, or the cam lift 20, is shown at the top.

Figure 3:
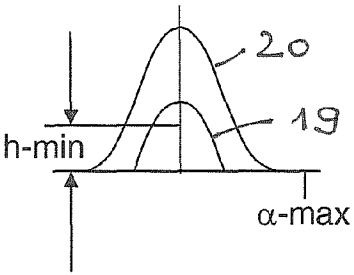
FIG. 3 shows the lift of the cam and of the gas exchange valve during the engine operating phase, in an enlarged view.

FIG. 1: in the course of the first cam lift 20, the hydraulic valve 15 supplied with current is switched currentless, so that when the control channel 12 is then opened, a part of the hydraulic medium situated in the pressure chamber 10 is displaced into the pressure relief chamber 11, and correspondingly the cam lift 20 is transmitted only partially to the gas exchange valve 3. The times at which the supply of current 21 to the hydraulic valve 15 is switched off and subsequently switched on again, and the corresponding time interval in which the hydraulic valve 15 is open and permits a refilling of the pressure chamber 10, are dimensioned such that at the beginning of the second cam lift only a specified partial volume of the pressure chamber 10 is filled with hydraulic medium. Together with a suitable controlling of the hydraulic valve 15, this has the result that in the subsequent engine operating phase, the cam lift 20 is transmitted only partially to the gas exchange valve 3, and is clearly recognizable in the late opening and early closing time, as well as in the smaller maximum stroke 19 of the gas exchange valve 3, relative in each case to the cam lift 20. The duration of the engine operating phase includes rotations 2 through n of the camshaft 6. The controlling of the hydraulic valve 15 takes place in such a way that on the one hand the hydraulic valve 15 is supplied with current during each overall cam lift phase 20 and consequently remains continuously closed during it. On the other hand, the time intervals between the cam lifts 20, in which the hydraulic valve 15 is not supplied with current and consequently is open, are dimensioned such that despite possible refilling of the pressure chamber 10 only a partial volume, with predetermined maximum hydraulic medium quantity, is contained therein. As explained above, the gas exchange valve stroke 19 moves in the prespecified limits of the minimum required stroke height h-min and the maximum permissible closing time point α-max, as shown in an enlarged view in FIG. 3.

The number, predetermined by electronic control module 16, of rotations of camshaft 6 during the engine operating phase is a function of the temperature of the hydraulic medium during the starting process of internal combustion engine 4. In the case of test bench hardware examined by applicant, at a hydraulic medium temperature of −20° C., 40 rotations were determined to be optimal, and at −30° C. 120 rotations were determined to be optimal.

After the conclusion of the initial warm-up phase of the internal combustion engine 4, i.e. after the engine operating phase with cam lifts 2 through n, the hydraulic valve 15 is supplied with current between nth and n+1th cam lift 20 in such a way that the pressure chamber 10 can be completely refilled with hydraulic medium. The electronic control module 16 is configured such that this also holds for all further rotations of the camshaft 6 during the subsequent further engine operating phase, which begins with the n+1th cam lift 20, and in which the hydraulic valve 15 is also closed and opened during the cam lift phase 20, in order to produce the stroke variability at the gas exchange valve 3 in a known manner.

FIG. 2: the essential difference from the sequence according to FIG. 1 is found in the controlling of the hydraulic valve 15 during the engine operating phase with rotations 2 through n of the camshaft 6. In this case, the possibility of a cycle-true partial refilling of the pressure chamber 10 between the cam lift phases 20 is omitted, by supplying current to the hydraulic valve 15 during the overall engine operating phase (current characteristic 21 during rotations 2 through n of the camshaft 6), so that the hydraulic valve consequently remains permanently closed. This is useful when a refilling of the pressure chamber 10 is used only to compensate unavoidable gap leakages from the pressure chamber 10, and the leakages are negligibly small, in the case of very high hydraulic medium viscosity.

LIST OF REFERENCE CHARACTERS

1 valve controlling
2 valve spring
3 gas exchange valve
4 internal combustion engine
5 cam
6 camshaft
7 tappet
8 first hydraulic piston
9 second hydraulic piston
10 pressure chamber
11 pressure relief chamber
12 control channel
13 pressure storage device
14 hydraulic medium supply
15 hydraulic valve
16 electronic control module
17 hydraulic valve brake
18 valve seat
19 gas exchange valve stroke
20 cam lift
21 current characteristic at hydraulic valve

The invention claimed is:

1. An internal combustion engine having an electrohydraulic valve control for a variable-stroke driving of a gas exchange valve upon which a spring force is applied in a closing direction, comprising a camshaft and a hydraulic system arranged to act as a drive between the camshaft and the gas exchange valve, said hydraulic system being connected to a hydraulic medium supply of the internal combustion engine, and having the following:

a first hydraulic piston driven by a cam of the camshaft, and a second hydraulic piston that drives the gas exchange valve in an opening direction, a pressure chamber delimited by the first hydraulic piston and by the second hydraulic piston, having a modifiable volume and a control channel that connects the pressure chamber to a pressure relief chamber, an electrically controlled hydraulic valve, situated in the control channel, that permits a flow of hydraulic medium through the control channel in an open position of the hydraulic valve, and that blocks said flow in a closed position of the hydraulic valve, and comprising an electronic control module for controlling the hydraulic valve as a function of operating parameters of the internal combustion engine, the electronic control module is configured to control the hydraulic valve as a function of at least one of an operating hydraulic medium temperature, viscosity, or an operating pressure in the hydraulic medium supply, such that during an engine operating phase that includes a starting process of the internal combustion engine and includes one or immediately successive rotations of the camshaft, only a prespecified partial volume of the pressure chamber is filled with hydraulic medium, and the hydraulic valve is in the closed position at least during each overall lift phase of the cam, and during a further engine operating phase following the engine operating phase, which includes immediately successive rotations of the camshaft, the pressure chamber is at least almost completely refilled with hydraulic medium before each lift phase of the cam.

2. The internal combustion engine as recited in claim 1, wherein the hydraulic valve is in the closed position during an overall engine operating phase.

3. The internal combustion engine as recited in claim 1, wherein the internal combustion engine is at ambient temperature at a time of the starting process.

4. The internal combustion engine as recited in claim 1, wherein a number of rotations of the camshaft during the engine operating phase is predetermined by the electronic control module as a function of the hydraulic medium temperature, determined at the time of the starting process of the internal combustion engine.

5. A method for operating an internal combustion engine having electrohydraulic valve controlling for variable-stroke driving of a gas exchange valve to which a spring force is applied in a closing direction, comprising a camshaft and a hydraulic system arranged to act as a drive between the camshaft and the gas exchange valve, said hydraulic system being connected to a hydraulic medium supply of the internal combustion engine, and having the following:

a first hydraulic piston driven by a cam of the camshaft, and a second hydraulic piston that drives the gas exchange valve in an opening direction, a pressure chamber delimited by the first hydraulic piston and by the second hydraulic piston, having a modifiable volume and a control channel that connects the pressure chamber to a pressure relief chamber, an electrically controlled hydraulic valve, situated in the control channel, that permits a flow of hydraulic medium through the control channel in an open position of the hydraulic valve, and that blocks said flow in a closed position of the hydraulic valve, and comprising an electronic control module for controlling the hydraulic valve as a function of operating parameters of the internal combustion engine, the electronic control module is configured to control the hydraulic valve as a function of at least one of an operating hydraulic medium temperature, viscosity, or an operating pressure in the hydraulic medium supply, the method comprising the following steps, which follow one another temporally:

opening of the hydraulic valve at a time within a lift phase of the cam and closing of the hydraulic valve at a time such that only a predetermined partial volume of the pressure chamber is filled with hydraulic medium, and holding the hydraulic valve in the closed position during an engine operating phase that includes a starting process of the internal combustion engine and includes one, or immediately successive, rotations of the camshaft, the hydraulic valve being in the closed position at least during each overall lift phase of the cam, and during a further engine operating phase that follows the engine operating phase, said further engine operating phase including immediately successive rotations of the camshaft, the hydraulic valve is controlled such that the pressure chamber is refilled at least almost completely with hydraulic medium before each lift phase of the cam.

* * * * *